US005511258A

United States Patent [19]

Barr, Sr.

[11] Patent Number: 5,511,258

[45] Date of Patent: Apr. 30, 1996

[54] BABY CRADLE

[76] Inventor: Samuel P. Barr, Sr., 918 Second St., Kotzebue, Ak. 99752

[21] Appl. No.: 448,113

[22] Filed: May 23, 1995

[51] Int. Cl.[6] ..... A47D 9/00

[52] U.S. Cl. ..... 5/104; 297/273; 472/118; 5/101

[58] Field of Search ..... 5/104, 101, 98.3; 297/273, 274; 472/118, 121, 122

[56] References Cited

U.S. PATENT DOCUMENTS

| | | | |
|---|---|---|---|
| 523,337 | 7/1894 | Ebert | 5/101 |
| 582,215 | 5/1897 | Martin . | |
| 595,235 | 12/1897 | Amrock | 5/101 |
| 756,230 | 4/1904 | Goddard . | |
| 894,008 | 7/1908 | Ince | 5/101 |
| 1,252,824 | 1/1918 | Melniker . | |
| 2,467,890 | 4/1949 | Harvey . | |
| 4,289,310 | 9/1981 | Weakly | 472/118 |
| 4,375,110 | 3/1983 | Murphy | 5/122 |
| 4,550,456 | 11/1985 | Allen | 5/98.1 |

FOREIGN PATENT DOCUMENTS

| | | | |
|---|---|---|---|
| 710839 | 8/1931 | France | 297/274 |
| 1562135 | 3/1980 | United Kingdom | 5/104 |

*Primary Examiner*—Alexander Grosz
*Attorney, Agent, or Firm*—Jacobson, Price, Holman & Stern

[57] ABSTRACT

A baby cradle is secured to a horizontally extending member of a movable baby cradle support or a joist beam of a ceiling by an eye hook secured to the horizontal member or joist beam of the ceiling. Secured within the eye hook is a snap swivel having two parts which are rotatable with respect to each other about a vertical axis. An eye opening of the snap swivel holds one end of a support spring and one end of a safety rope. At an opposite end of the support spring is a two inch diameter brass ring to which the opposite end of the spring is secured, as well as the opposite end of the safety rope. Preferably, the spring between the eye opening of the snap swivel and the brass ring located at its lower extremity is 8½ inches long and 1 inch wide. The safety rope, preferably ¼ inch nylon rope, extends through the center of the support spring and is of a preferable length of 2 feet.

3 Claims, 2 Drawing Sheets

FIG. 1
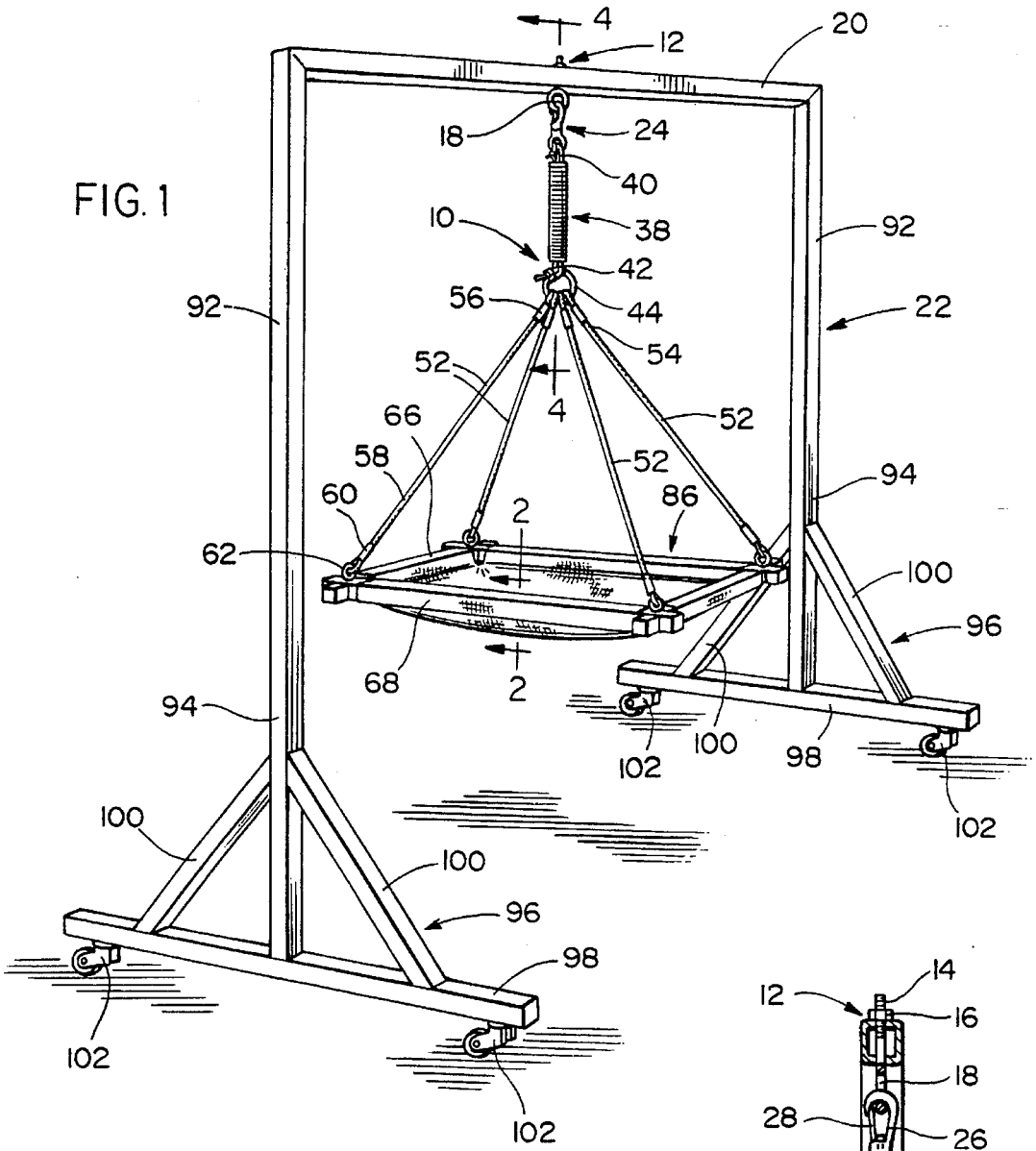
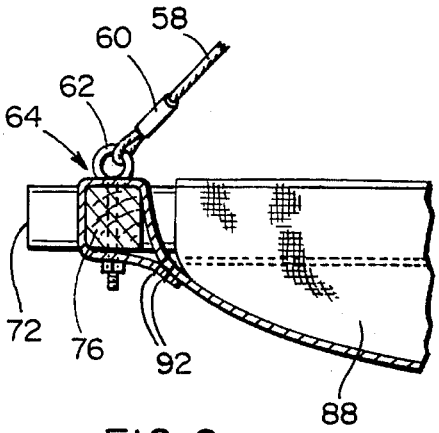
FIG. 2
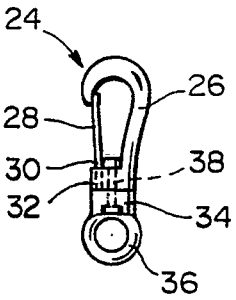
FIG. 3
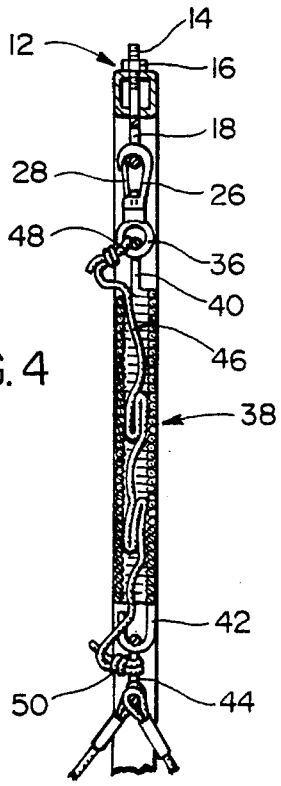
FIG. 4

BABY CRADLE

FIELD OF THE INVENTION

This invention relates to a baby cradle which is suspendable from an overhead beam and includes a steel spring to allow vertical movement of the cradle suspended from the spring. A rope extends through the spring as a safety feature to prevent excessive falling of the cradle in the event of breakage of the spring.

BACKGROUND OF THE INVENTION

Prior attempts in suspending an infant from an overhead support have included U.S. Pat. No. 523,337 to Ebert, U.S. Pat. No. 582,215 to Martin, U.S. Pat. No. 595,235 to Amrock, U.S. Pat. No. 756,230 to Goddard, U.S. Pat. No. 1,252,824 to Melniker, U.S. Pat. No. 2,467,890 to Harvey, U.S. Pat. No. 4,375,110 to Murphy and U.S. Pat. No. 4,550,456 to Allen. In these patents, a crib, cradle or hammock is suspended from a support.

In the patents to Martin and Goddard, a crib or cradle are suspended by a spring from a support located above the crib or cradle. In these two patents, the range of rotation of the crib or cradle about a central vertical axis is limited. In addition, no precautions are employed in the event of breakage of the suspending spring.

SUMMARY OF THE INVENTION

Accordingly, it is a primary object of the present invention to provide a baby cradle which is suspended from an overhead support by a spring having a safety rope extending through the center of the spring to secure the cradle to an overhead support in the event of breakage of the spring. In addition, the cradle is rotatable about a central vertical axis of the cradle.

A baby cradle made in accordance with the principles of the present invention is secured to a horizontally extending member of a movable baby cradle support or a joist beam of a ceiling by an eye hook secured to the horizontal member or joist beam of the ceiling. Secured within the eye hook is a snap swivel having two parts which are rotatable with respect to each other about a vertical axis. An eye opening of the snap swivel holds one end of a support spring and one end of a safety rope.

At an opposite end of the support spring is a two inch diameter brass ring to which the opposite end of the spring is secured, as well as the opposite end of the safety rope. Preferably, the spring between the eye opening of the snap swivel and the brass ring located at its lower extremity is 8½ inches long and 1 inch wide. The safety rope, preferably ¼ inch nylon rope, extends through the center of the support spring and is of a preferable length of 2 feet.

Suspended from the brass ring at the lower extremity of the support spring are four 2½ feet long, ¼ inch diameter lengths of nylon rope. The four lengths of rope are anchored at eye bolts located at corner points of a cradle. The cradle is formed by two sets of parallel bars including two transverse, cross-piece bars of 2¾ inches by 1 inch by 1 foot, 8 inches, including notched cut-outs engaging with two parallel extending elongated bars of 2¾ inches by 1 inch by 2 feet, 6 inches, having cut-out notches shaped complementary to the cut-out notches of the transverse bars. The anchors for the opposite ends of the four sections of rope are secured to ¼ inch by 1¼ inch eye bolts passing through the point of engagement of the parallel elongated bars and the perpendicular extending cross-piece bars. The four bars are made of hickory wood or any other hard wood.

Extending between the four bars forming the cradle frame is a canvas or any other tough fabric, sewn around the frame bars between the corner eye bolts. The overall starting dimension of the canvas, prior to securing to the frame bars is approximately 3 feet, 2 inches by 2 feet, four inches. The frame bars are secured by the threaded end of the eye bolt passing through a washer, a nut and a cap nut.

In the use of a baby cradle in accordance with the principles of the present invention, a movable support frame may be used made of tubular steel. The frame includes wheels supporting lowermost portions of the frame for moving the frame to different locations.

Accordingly, it is another object of the present invention to provide a spring support for a baby cradle with a safety rope passing through the spring to secure the cradle in the event of breakage of the spring.

It is yet another object of the present invention to provide a baby cradle supported by a spring on a snap swivel for rotation of the cradle about a central vertical axis of the cradle.

It is still yet another object of the present invention to provide a baby cradle supported by a spring having a safety rope passing through the center of the spring and connecting the safety rope to the upper and lower anchor points of the spring so as to prevent dropping of the cradle to the floor upon breakage of the spring.

It is still another object of the present invention to provide a baby cradle having a support spring anchored to a horizontal member of a support frame or a ceiling joist.

These and other objects of the invention, as well as many of the intended advantages thereof, will become more readily apparent when reference is made to the following description taken in conjunction with the accompanying drawings.

BRIEF DESCRIPTION OF THE DRAWINGS

FIG. 1 is a perspective view of a baby cradle connected by a spring support to a horizontal member of a movable support frame.

FIG. 2 is a sectional view taken along line 2—2 of FIG. 1.

FIG. 3 is an enlarged view of a snap swivel for interconnecting an eye hook connected to a horizontal member of a support frame or a ceiling joist and a support spring for a baby cradle.

FIG. 4 is a sectional view taken along line 4—4 of FIG. 1.

DETAILED DESCRIPTION OF THE PREFERRED EMBODIMENTS

Figure 5:
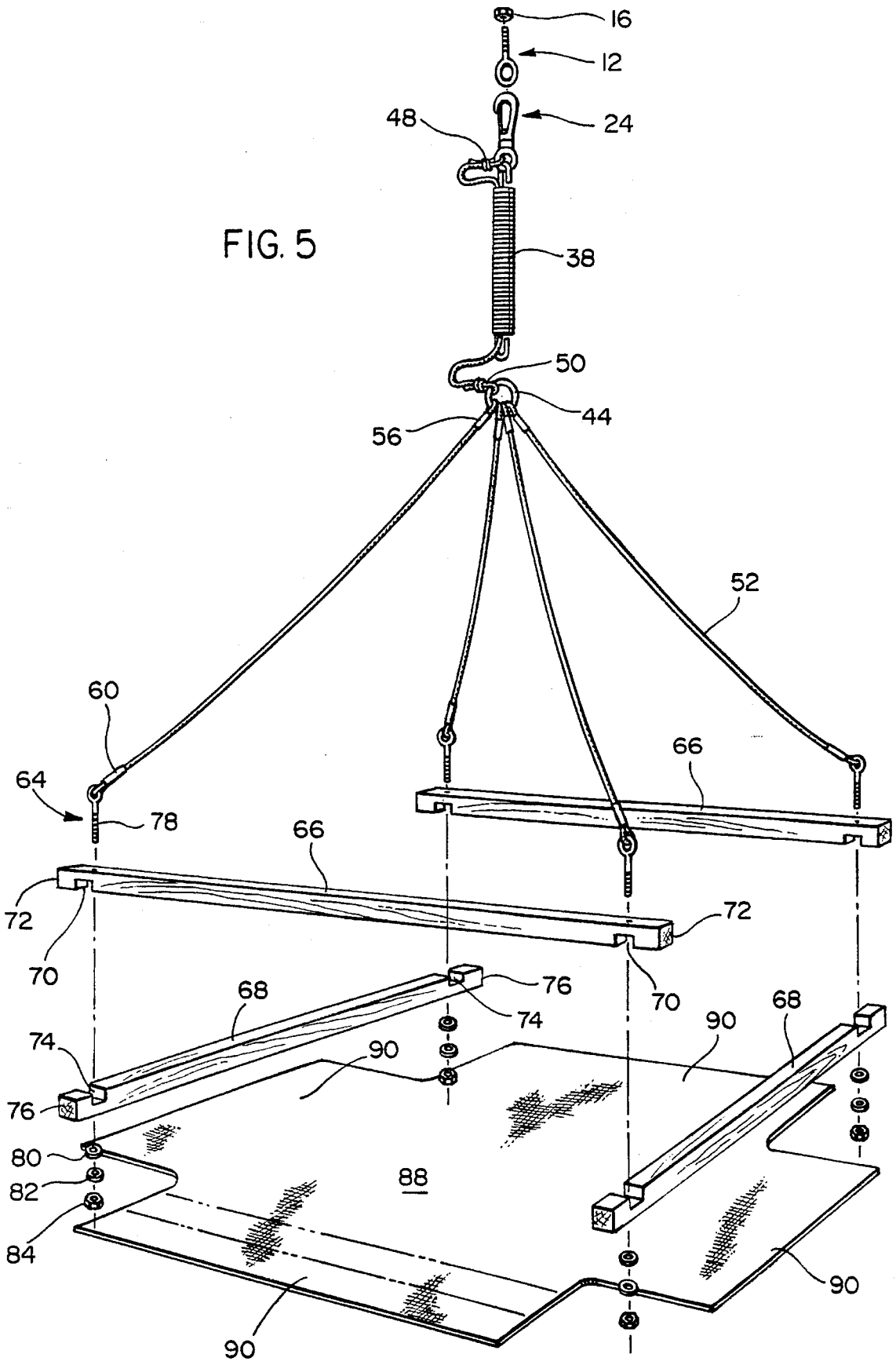
FIG. 5 is an exploded view of the baby cradle and support spring connected to a snap swivel for passage through an eye hook connected to a horizontal member of a support frame or a ceiling joist.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to the drawings, in general, and to FIGS. 1 through 4, in particular, a baby cradle assembly embodying the teachings of the subject invention is generally designated as 10. With reference to its orientation in FIG. 1, the baby cradle assembly comprises an eye hook 12 having a threaded shaft 14 onto which is secured a nut 16 on the opposite end from the eye opening 18.

In the embodiment shown in FIG. 1, the eye hook 12 is secured to a horizontal cross-piece 20 of a movable support frame 22. In an alternate embodiment of the present invention, the eye hook terminates in a pointed end so as to secure the eye hook in a joist of a ceiling for suspension of the eye hook from the joist of the ceiling.

Secured within the eye opening 18 of the eye hook 12 is a snap swivel 24. The snap swivel 24, enlarged in FIG. 3, includes a hooked portion 26 and a flexible portion 28 anchored at one end 30 in a base 32 of the hook portion 26. The flexible portion 28 is pressed towards the hook portion 26 to allow securing of the snap swivel 24 to the eye opening 18.

In the snap swivel 24, a separate part 34, terminating in an eye opening 36 is rotatably mounted on the base 32 by an interconnecting pin shaft 38 extending through the base 32 and part 34 to hold these two parts together while being rotatable 360° with respect to one another. Unless the flexible portion 28 is manually moved, the snap swivel will remain secured to the eye opening 18 due to the bias of the flexible portion 28.

Secured to the eye opening 36 of the snap swivel 24 is a support spring 38. One end 40 of the support spring 38 passes through the eye opening 36 to secure the support spring 38 in position. At the opposite end 42 of the support spring 38 is a two inch diameter ring 44 through which the end 42 passes for engagement with the ring 44.

Passing centrally through the support spring 38 is a safety line 46 having one end 48 tied to the eye opening 36 of the snap swivel 24. Its opposite end 50 is tied to the ring 44. The safety line is approximately 2 feet long and preferably made of nylon rope. If for any reason the support spring 38 should break, the safety line will retain the connection between the snap swivel 24 and the ring 44 after a fall of approximately 15 inches.

Connected to the ring 44 are four rope sections 52. One end 54 of each rope section 52 is bent through the ring 44 and back onto itself and rigidly secured to itself by metal clip 56. The opposite ends 58 of rope sections 52 are connected by metal bands 60 after passing through an eye opening 62 of an eye bolt 64.

Eye bolt 64 passes through the intersection between two elongated parallel bars 66 which are interconnected by two cross-piece bars 68, which extend parallel to each other and perpendicular to the bars 66. The bars 66 each include downwardly facing notches 70 spaced approximately one inch from the opposite ends 72 of the bars 66. The notches are approximately ¾ inch wide and are complementary shaped to the upperwardly facing notches 74, located approximately one inch from the ends 76 of the cross-piece bars 68. The shaft portion 78 of the eye hooks 64 passes through the notches 70, 74 of the bars 66, 68 and engages a washer 80, a nut 82 and a cap nut 84.

The bars 66, 68 collectively form a frame for a cradle 86. The cradle is formed of a canvas fabric 88 or other suitable tough fabric. The canvas 88 is cut into an approximate cross-shape, as shown in FIG. 5, with projecting portions 90 folded around the bars 66, 68, and stitched upon themselves by stitching 92, as shown in FIG. 2o In one embodiment, the assembly 10 is suspended from a frame 22. The frame 22, in addition to the cross-piece 20, includes vertically rising posts 92 which are interconnected by the cross-piece 20. At a lower end 94, a movable support structure 96 includes horizontally extending members 98 interconnected by cross braces 100 to the vertically extending posts 92. Located on an underside of the horizontally extending members 98 are two castor wheel assemblies 102 for movement of the support frame 22 in all directions.

In addition, by the connection of the cradle 86 to a snap swivel 24, it is possible to rotate the cradle through 360° of rotation along a vertical axis extending centrally through the spring support 38 and the center of the cradle 86. By this rotation, a wide range of motion is possible to an infant or young child held in the cradle by the assembly 10 acting as a swing or due to the movement of the infant or child in the cradle under their own power. It is understood that appropriate securing belts would be included with the cradle to secure a child in the cradle.

By the present invention, a cradle providing a wide range of movement and rotation is provided. In addition, a safety rope is provided to prevent excessive falling of the cradle in the event of breakage of the support spring.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A baby cradle assembly comprising:

a baby cradle including a frame, a fabric material connected across said frame for supporting a child, four support lines connected to a ring at one end and extending from said ring to said frame at the other end, a spring support connected to said ring of said baby cradle, a snap swivel for securing said baby cradle to a movable overhead support frame, said snap swivel including two parts rotatable with respect to each other for rotation of said baby cradle through 360° of rotation, an eye opening of said snap swivel being connected to said spring support, and safety means connecting said baby cradle to said snap swivel for providing a connection between said baby cradle and said snap swivel in the event of breakage of said spring support.

2. A baby cradle assembly as claimed in claim 1, wherein said snap swivel is connected to a cross-piece of said support frame.

3. A baby cradle assembly as claimed in claim 1, wherein said safety means is longer than a length of said spring support.

* * * * *